US006102016A

United States Patent [19]

Sitar et al.

[11] Patent Number: 6,102,016

[45] Date of Patent: Aug. 15, 2000

[54] EGR SYSTEM AND IMPROVED ACTUATOR THEREFOR

[75] Inventors: Michael J. Sitar; David W. Deppe, both of Marshall; Bill D. Wood, Albion, all of Mich.

[73] Assignee: Eaton Corporation, Cleveland, Ohio

[21] Appl. No.: 09/249,715

[22] Filed: Feb. 12, 1999

[51] Int. Cl.[7] ..... F02M 25/04

[52] U.S. Cl. ..... 123/568.23; 254/129.13

[58] Field of Search ..... 123/568.23; 251/129.11, 251/129.12, 129.13

[56] References Cited

U.S. PATENT DOCUMENTS

| | | | |
|---|---|---|---|
| 4,690,119 | 9/1987 | Makino et al. | 123/571 |
| 5,606,957 | 3/1997 | Feucht | 123/571 |
| 5,937,835 | 8/1999 | Turner et al. | 123/568.24 |
| 6,012,437 | 1/2000 | Radhamohan et al. | 123/568.23 |

*Primary Examiner*—Henry C. Yuen
*Assistant Examiner*—Arnold Castro
*Attorney, Agent, or Firm*—L. J. Kasper

[57] ABSTRACT

An exhaust gas recirculation system (11) for an internal combustion engine, including a valve (25) having a closed position (FIG. 2) blocking flow of exhaust gas, the valve being biased by gas pressure in the exhaust gas passage (E) toward a closed position (FIG. 2). The system includes an electric motor (51) having an input gear (55) and a gear train (57,59) driving a sector gear (73). A linkage member (93) has its ends (91,95) connected to the sector gear (73) and the valve stem (29), respectively. The sector gear and the linkage member are configured such that, as the valve begins to open against exhaust gas pressure, the movement of the valve stem is a relatively higher force, and at a relatively lower speed. As the valve moves toward a fully open position (FIG. 7), the movement of the valve stem is at a relatively lower force, but at a relatively higher speed.

11 Claims, 7 Drawing Sheets

EGR SYSTEM AND IMPROVED ACTUATOR THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an exhaust gas recirculation system for controlling the flow of exhaust gas from an exhaust gas passage to an engine intake passage of an internal combustion engine, and more particularly, to an actuator assembly for an exhaust gas recirculation system.

Although the use of the present invention is not limited to any particular type of engine, its use is especially advantageous in connection with a diesel engine, for reasons which will become apparent subsequently.

Typically, exhaust gas recirculation (EGR) valves have been disposed between the engine exhaust manifold and the engine intake manifold, and have been operable, when in the open position, to permit the recirculation of exhaust gas from the exhaust side of the engine back to the intake side. As is well known to those skilled in the art, such recirculation of exhaust gasses is helpful in reducing various engine emissions.

An EGR system including an electrically operated type actuator is illustrated and described in U.S. Pat. No. 5,606,957. The actuator for the valve stem in the cited patent is a stepper motor, which is generally satisfactory in performing the basic function of opening and closing the EGR valve. However, in most vehicle applications for EGR valves, and especially in diesel engine applications, it must be possible to close the EGR valve within about fifty milliseconds of the time the closing command is generated, and to open the EGR valve within about 100 millisecond of the time the opening command is generated, and the device of the cited patent is not typically capable of such rapid opening and closing.

Co-pending application U.S. Ser. No. 08/881,622, Filed Jun. 24, 1997 in the names of Edwin D. Lorenz, Glen R. Lilley and David Turner for an "EGR SYSTEM AND IMPROVED ACTUATOR THEREFOR", assigned to the assignee of the present invention, teaches an improved actuator for an EGR valve. In the co-pending application, the actuator includes an electric motor of the relatively high-speed, continuously rotating type, such as a permanent magnet DC commutator motor, which provides a relatively high-speed, low torque output. The actuator also includes a reduction gear train, the output of which is a relatively high torque, low speed rotation of an output gear which is connected by a suitable linkage to the stem of the EGR valve. Although the actuator of the co-pending application provided generally satisfactory performance, and is able to open and close the EGR valve within the required time periods, the reduction gear train set forth therein resulted in excessive size, complexity and cost in the overall actuator assembly.

U.S. Pat. No. 4,690,119 shows an actuator for an EGR valve in which the output of a motor, such as a stepper motor, is transmitted by means of an output gear to an actuator assembly including a sector gear. Pivotal movement of the sector gear in response to operation of the motor moves the EGR valve through a linkage member. In the device of the cited patent, which appears to be intended for use with only an Otto cycle engine, the various flow passages and the valve seat are arranged such that the pressure of exhaust gas in the exhaust manifold would tend to bias the EGR valve toward an open position. Thus, the performance criteria for the actuator to open the EGR valve, assisted by the gas pressure, are not especially severe, and in the cited patent, the sector gear is arranged to provide a relatively constant level of torque and speed when opening the EGR valve.

Many diesel engines are turbo charged, which means that the exhaust gas pressure in the exhaust manifold must be substantially above atmospheric pressure, in view of the fact that it is the pressure in the exhaust manifold which drives the input (impeller) of the turbo charger. In such turbo charged diesel engines, it is considered necessary for the EGR valve to be of the "pressure biased closed" type rather than being of the "pressure biased open" type, as is the device shown in above-cited U.S. Pat. No. 4,690,119. If the EGR valve of a turbo charged diesel engine were of the "pressure biased open" type, the elevated exhaust manifold pressures would result in substantial leakage of exhaust gas into the intake manifold, at times when such leakage is not desirable. However, by making the EGR valve of the pressure biased closed type, there is a much greater "opening force" required for the actuator assembly.

BRIEF SUMMARY OF THE INVENTION

Accordingly, it is an object of the present invention to provide an improved EGR system and actuator for an EGR valve of the pressure biased closed type, wherein the actuator is able to open the EGR valve in opposition to the force of the exhaust gas pressure.

It is a related object of the present invention to provide an improved EGR valve and actuator which accomplishes the above-stated object, and which is still capable of opening the EGR valve within the very short period of time typically specified.

It is a more specific object of the present invention to provide an improved EGR system and actuator therefor wherein the ratio of motor rotation to valve displacement is variable, and decreases as the EGR valve moves from its closed position to an open position.

The above and other objects of the invention are accomplished by the provision of an improved exhaust gas recirculation system for an internal combustion engine, the system having a valve including a valve stem, the valve being moveable between a closed position, blocking communication from an engine exhaust gas passage to an engine intake passage, and an open position. Pressure in the engine exhaust gas passage biases the valve toward the closed position. The system comprises housing means and an electric motor operably associated with the housing means and with an input gear to provide a relatively high speed, low torque motion to the input gear, in response to changes in an electrical input signal to the electric motor. The input gear is in driving engagement with an internally-toothed sector gear pivotable about a first axis. Linkage means is operably associated with the sector gear and with the valve stem for transmitting pivotal movement of the sector gear into the axial movement of the valve stem.

The improved exhaust gas recirculation system is characterized by the sector gear and the linkage means being configured whereby, as the valve moves from the closed position toward the open position, the sector gear and the linkage means first generate an axial movement of the valve stem at a relatively higher force and at a relatively lower speed. Then, as the valve opens further, the sector gear and the linkage means generate an axial movement of the valve stem at a relatively lower force, and at a relatively higher speed.

DETAILED DESCRIPTION OF THE PREFERRED EMBODIMENT

Figure 1:
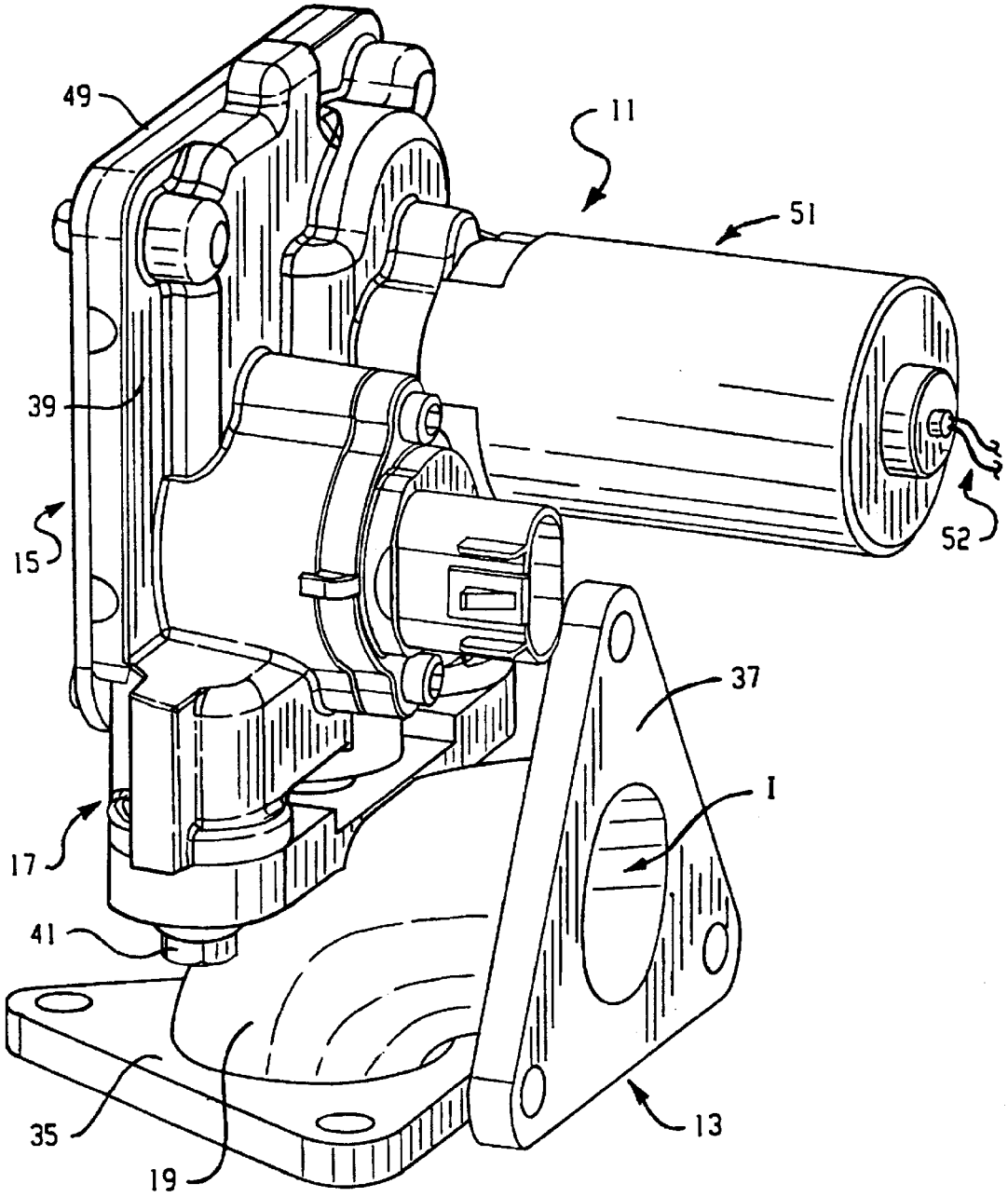
FIG. 1 is a generally rearward, perspective view of the EGR system and actuator assembly of the present invention.

Referring now to the drawings, which are not intended to limit the invention, FIG. 1 illustrates an exhaust gas recirculation system, generally designated 11. The EGR system 11 may include a plurality of sections, and in the subject embodiment, includes a manifold portion 13, an actuator portion 15, and a heat transfer (cooling) portion 17 (see FIG. 2). The cooling portion 17 is disposed between the manifold portion 13 and the actuator portion 15.

As is well known to those skilled in the art, an EGR system may be plumbed into the engine exhaust and intake system in a number of ways, the specific arrangement for doing so not comprising part of the present invention, except as is specifically otherwise noted, and therefore, a plumbing arrangement will be illustrated herein, which is shown only schematically, and only by way of example.

The manifold portion 13 comprises a manifold housing 19 defining a passage 21 (see FIG. 2), and a bore 23 within which a valve member, generally designated 25, is reciprocably supported for axial movement therein. The valve member 25 includes a poppet valve portion 27 formed integrally with a valve stem 29.

Figure 2:
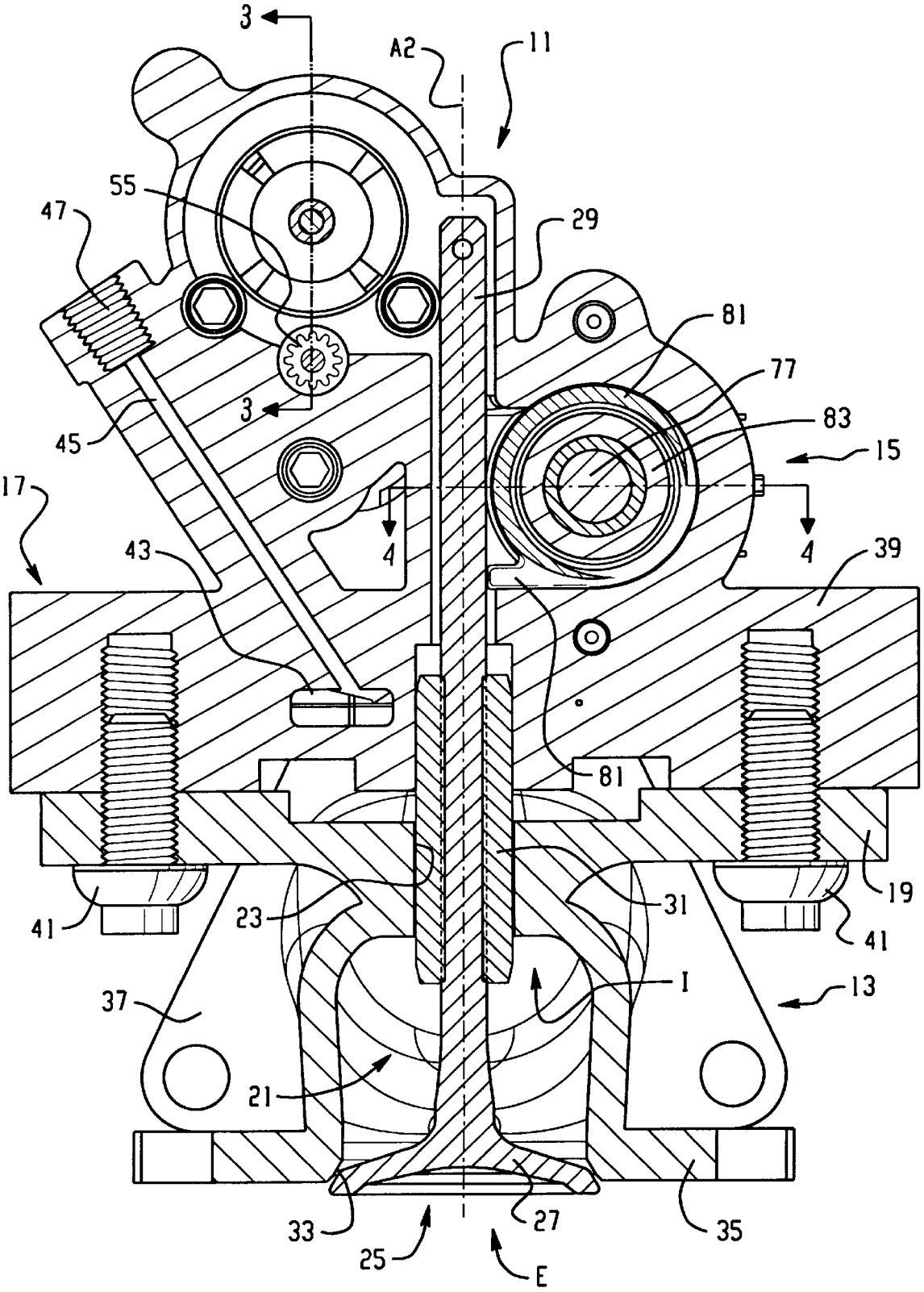
FIG. 2 is an axial, vertical cross-section, viewed from the front of the EGR system and actuator assembly shown in FIG. 1, with the valve in the closed position.

The manifold housing 19 defines a valve seat 33, against which the poppet valve portion 27 seats when the valve member 25 is closed, such that the valve seat 33 serves as the "close stop". In FIG. 2, although the poppet valve portion 27 is shown spaced slightly apart from the valve seat 33, for clarity of illustration, what is shown in FIG. 2 will be referred to subsequently hereinafter as representative of the closed position of the valve member 25. By way of example only, the manifold housing 19 includes a flange 35 for connection to an exhaust manifold (not shown herein) such that the region below the poppet valve portion 27 in FIG. 2 comprises an exhaust gas passage E. At the downstream end of the passage 21, the manifold housing 19 includes a flange 37, for connection to an intake manifold, such that the downstream end of the passage 21 may be referred to as an intake passage I.

Referring still primarily to FIGS. 1 and 2, the actuator portion 15 and the heat transfer portion 17 are illustrated herein as comprising a single, integral housing member 39, with the manifold housing 19 being attached to an underside surface of the housing member 39 by any suitable means, shown herein as a plurality of bolts 41. The reason that the lower portion of the housing member 39 is referred to as a "heat transfer portion 17" is that the housing member 39 defines a coolant chamber 43, which is adapted to receive engine coolant through a passage 45 having, at the exterior of the housing member 39 a port 47, adapted to receive a fitting which, in turn, is connected to the remainder of the engine coolant circuit (not shown herein). As is well known to those skilled in the art, the contact of the manifold housing 19 with hot exhaust gasses, flowing from the exhaust gas passage E to the intake passage I, will result in the manifold housing 19 becoming quite hot, for example, in excess of 550° Fahrenheit. In accordance with one important aspect of the design shown herein, the heat transfer portion 17 is disposed between the manifold portion 13 and the actuator portion 15, to serve as a thermal barrier, to keep the actuator portion 15 as cool as possible, and preferably under about 250° Fahrenheit.

Referring again primarily to FIG. 1, the actuator portion 15 will be described in some detail. The housing member 39 has, attached to a forward surface thereof by any suitable means, a cover 49. Attached to the rearward surface of the housing member 39 is the casing of an electric motor, generally designated 51, the particular construction and specification of which are not essential to the present invention. However, for reasons explained in the BACKGROUND OF THE DISCLOSURE, it is preferred that the electric motor 51 is of the relatively high speed, continuously rotating type, and although the electric motor 51 could, within the scope of the invention, comprise a brushless DC motor, it is preferred to use a permanent magnet DC commutator motor, or any other motor with a high torque-to-inertia ratio. The electric motor 51 receives an electrical input by means of a pair of leads or wires, shown somewhat schematically at 52.

Figure 3:
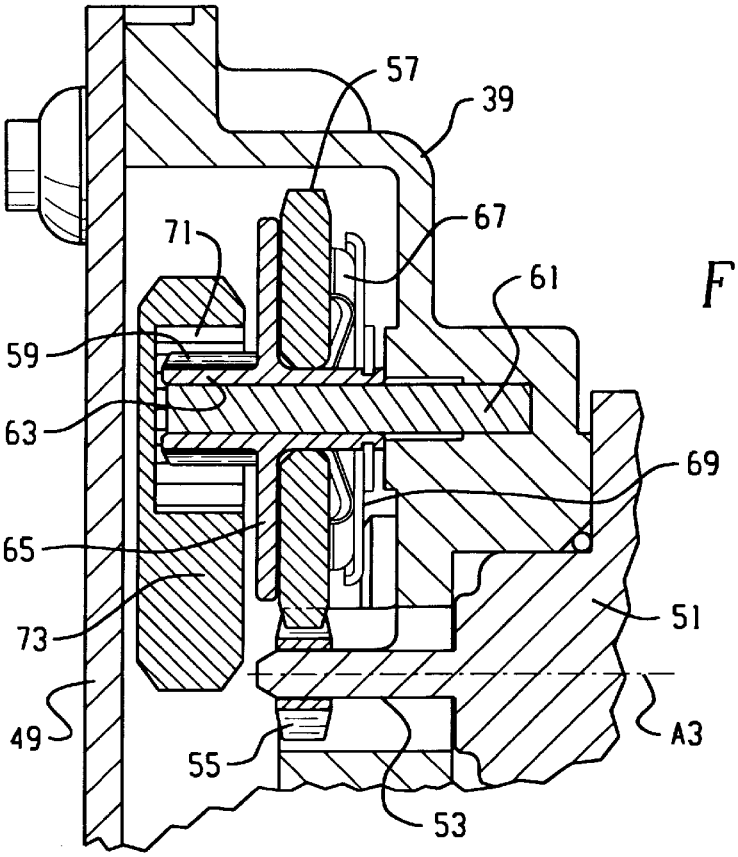
FIG. 3 is an enlarged, fragmentary, vertical, transverse cross-section, taken generally on line 3—3 of FIG. 2.

Referring now to FIGS. 2 and 3, in conjunction with FIG. 1, the electric motor 51 provides a low torque, high speed rotary output at a motor output shaft 53, on which is mounted a motor pinion gear 55. The motor pinion gear 55 comprises the input gear of a gear train, the general function of which is to translate the relatively low torque, high speed rotary output of the electric motor 51 into a relatively high torque, low speed rotary output which may be transmitted to the valve member 25. The motor pinion gear 55 is in meshing engagement with a relatively larger gear 57 which, in turn, drives a relatively smaller pinion 59. The gear 57 and pinion 59 are referred to as being "relatively larger" and "relatively smaller", respectively, merely to indicate that the function of the gear train is progressively to reduce the speed while increasing the torque and thus, it is believed to be within the ability of those skilled in the art to select particular gears and pinions, and the tooth ratio therebetween.

Referring now only to FIG. 3, the larger gear 57 has operably associated therewith a torque limiting (slipping)

coupling. Such a torque limiting coupling is illustrated and described in greater detail in the co-pending application cited above, and incorporated herein by reference. It should be understood that the particular construction and operation of the coupling shown in FIG. 3 is not an essential feature of the present invention, although it is important to the proper operation of EGR systems of the type shown herein to have some sort of torque limiting coupling. The coupling includes a shaft 61, one end of which is journalled within the housing member 39. Disposed about the left end (in FIG. 3) of the shaft 61 is the pinion 59, and disposed radially between the shaft 61 and the pinion 59 is a cylindrical portion 63 of a slip member 65. The cylindrical portion 63 and the pinion 59 are fixed to rotate together, and the gear 57 is biased into frictional engagement with a radially-extending portion of the slip member 65 by means of a leaf spring 67, which is restrained in the axial direction by a retainer and snap ring assembly 69. As is well known to those skilled in the art of torque limiting couplings or slip clutches, the gear 57 and pinion 59 will rotate as a unit up to a predetermined, maximum input torque, above which the torque will exceed the capacity of the spring 67, and the gear 57 will begin to slip relative to the slip member 65, and therefore, will begin to slip relative to the pinion 59.

The reason for including this slipping capability in the gear train is primarily to protect the gear train, and especially the gear teeth. A major portion of the torque generated by the electric motor 51 is required simply to overcome the inertia of the motor itself. With the full current being directed to the motor, the teeth of the gear train would be destroyed whenever the valve member 25 reached its close stop or its open stop in the absence of the torque limiting (slipping) capability described above. Within the scope of the present invention, the torque limiting clutch may be disposed at other locations within the entire torque transmitting path, but the location illustrated in FIG. 3 is preferred, because the torque limiting coupling may be associated with the gear 57 and the pinion 59 without adding substantially to the overall size and complexity of the device.

Figure 4:
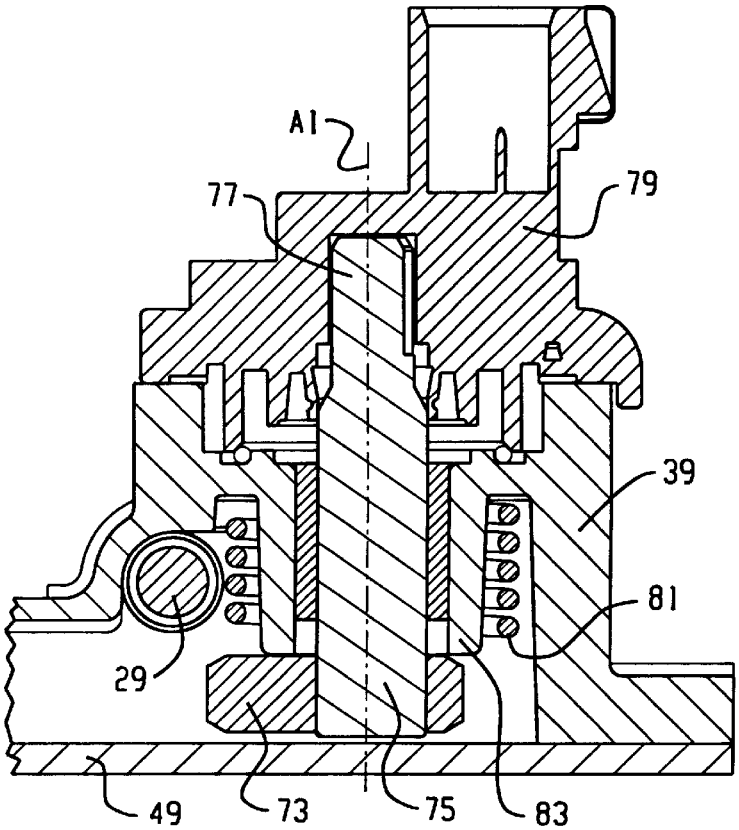
FIG. 4 is a an enlarged, fragmentary, horizontal, transverse cross-section, taken generally on line 4—4 of FIG. 2.
Figure 5:
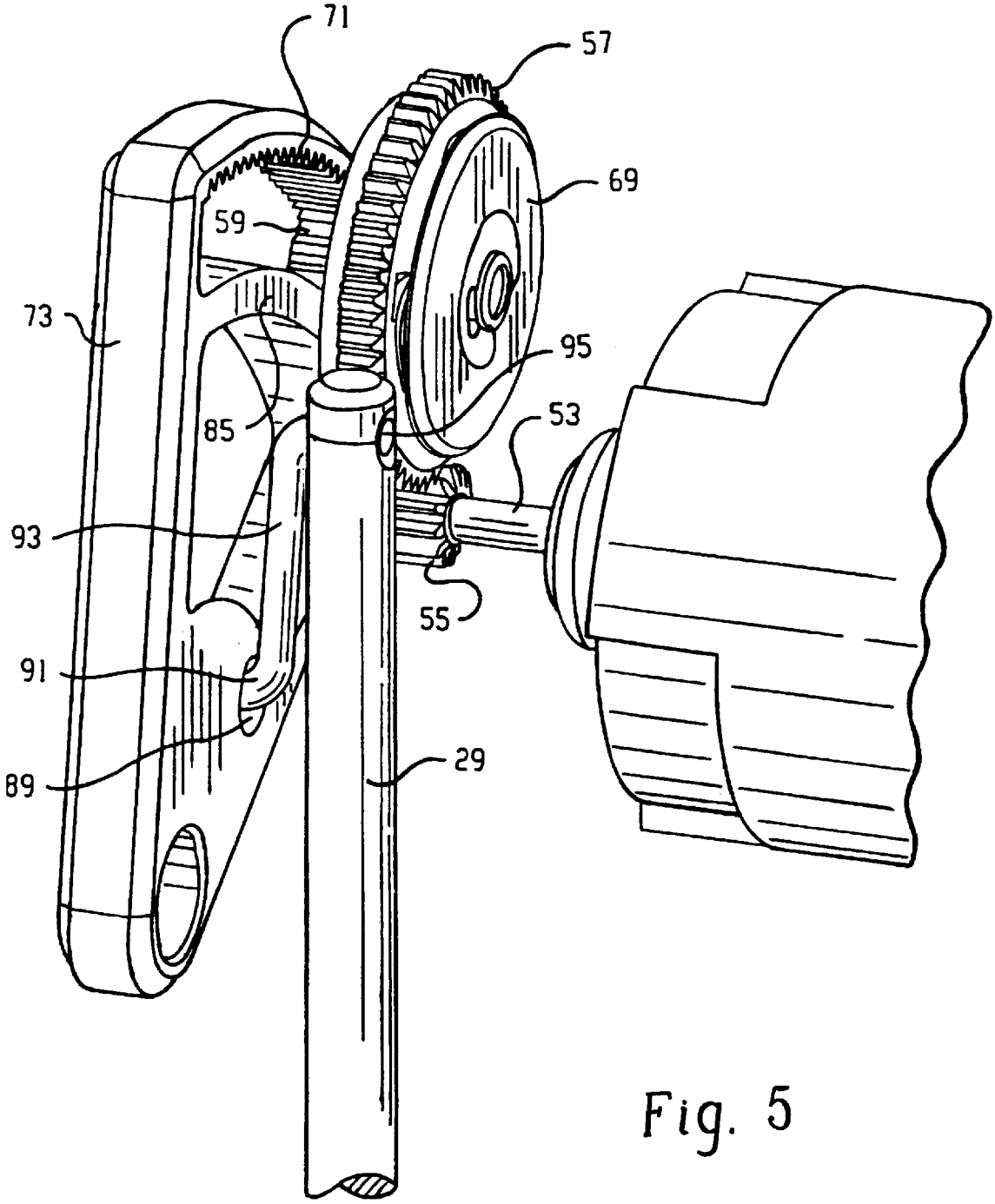
FIG. 5 is a generally rearward, perspective view, similar to FIG. 1, but on a larger scale, illustrating the gear train of the actuator assembly of the present invention.

Referring now primarily to FIGS. 4 and 5, in conjunction with FIG. 2, the smaller pinion 59 is in toothed engagement with a set of internal teeth 71 formed within a sector gear 73, which is shown fragmentarily in both FIGS. 3 and 4. As may best be seen in FIG. 4, the sector gear 73 is mounted for pivotal movement about the axis of a sector mounting shaft 75. In accordance with one significant aspect of the invention, the axis of the mounting shaft 75 comprises a first axis A1 (see FIG. 4), while the valve stem 29 defines a second axis A2 (see FIG. 2). Finally, the motor pinion (input) gear 55 defines a third axis A3 (see FIG. 3). Preferably, the first and third axes, A1 and A3, are substantially perpendicular to the second axis A2 of the valve stem 29, and the second axis A2 is disposed transversely between the axes A1 and A3, for reasons which will become apparent subsequently.

Referring still primarily to FIG. 4, a rearward end 77 of the mounting shaft 75 is disposed within a housing 79 adapted to house a shaft position sensor, not shown herein, the function of which is to provide a signal representative of the instantaneous rotational position of the mounting shaft 75, and therefore, of the sector gear 73. Surrounding the shaft 75 is a torsional spring 81 (see also FIG. 2), and disposed radially between the shaft 75 and the spring 81 is a generally cylindrical housing support portion 83, the function of which is to support the shaft 75 as it is subjected to loads in various directions. In accordance with one feature of the invention, the torsion spring 81 serves as the valve return spring, tending to bias the valve 25 toward its closed position shown in FIG. 2. In most prior art EGR valves, including U.S. Pat. No. 4,690,119, the valve stem is surrounded by a coil compression spring, biasing the valve toward its closed position, but such an arrangement takes up a substantial amount of space around the valve stem, whereas the present invention substantially improves the packaging of the EGR valve, as may best be seen in FIG. 2.

Figure 6:
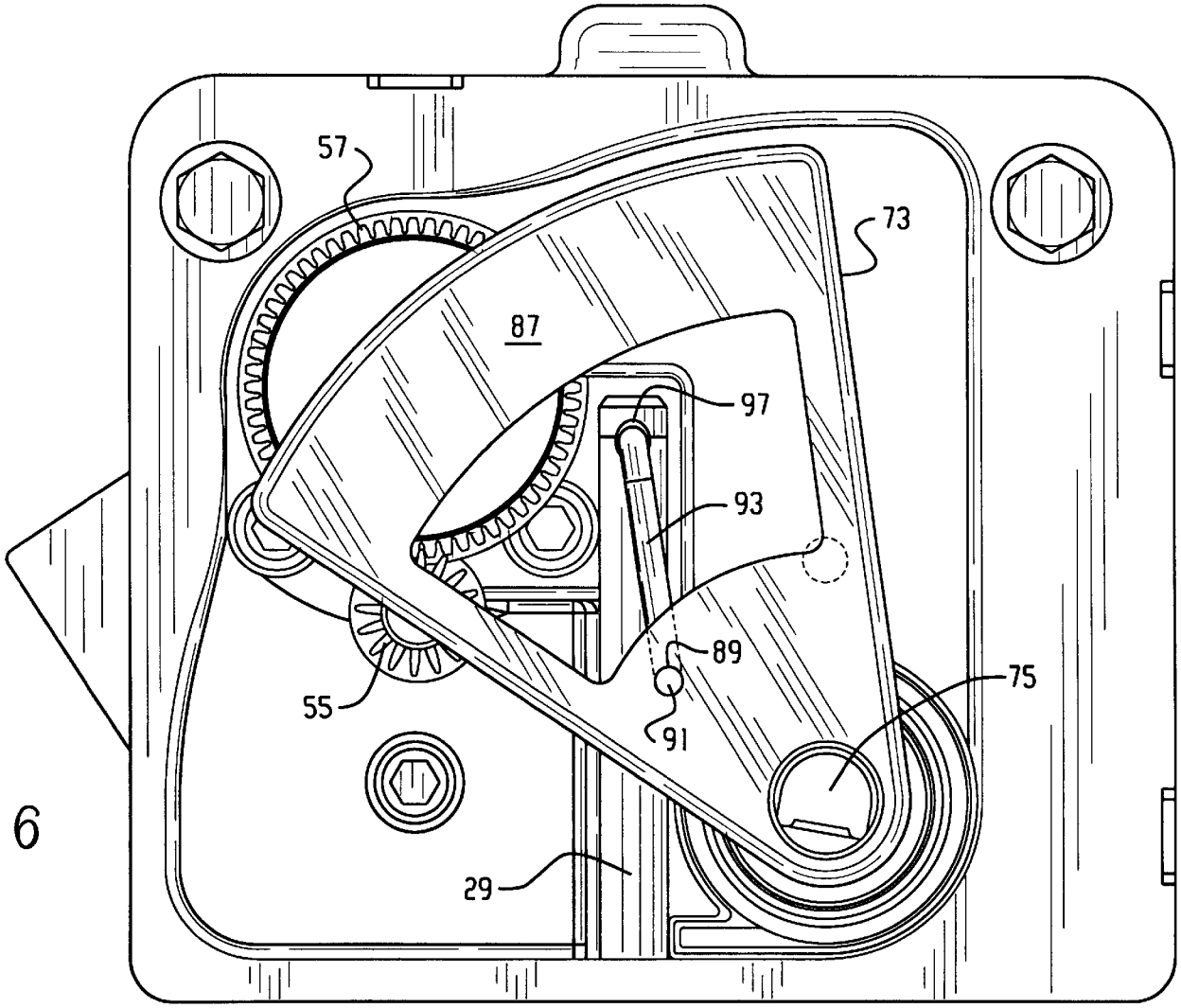
FIG. 6 is a front plan view, with the cover removed, of the upper portion of the actuator assembly, on a slightly smaller scale than FIG. 5, and corresponding to the valve closed position of FIG. 2.

Referring now primarily to FIGS. 5 and 6, the sector gear 73 will be described further. Preferably, the sector gear 73 includes an arcuate structural portion 85, extending circumferentially, and generally parallel to the internal teeth 71. As may best be seen in FIG. 6, it is preferred that the sector gear 73 be generally solid in the region of the mounting shaft 75, then open radially inward from the structural portion 85. Finally, it is preferred that the sector gear 75 include a cover portion 87 at the forward surface of the sector gear 75, extending radially from the structural portion 85 outward to the outer periphery thereof. In effect, the cover portion 87 forms an enclosure in the region of the internal teeth 71, such that lubrication fluid flowing into the mesh of the pinion 59 and teeth 71 will tend to splash around within that enclosure, and be retained therein, thus improving the lubrication of the tooth mesh.

Referring again primarily to FIGS. 5 and 6, the radially inner, solid portion of the sector gear 73 defines an opening 89 (see FIG. 5), and extending into the opening 89 from the rearward end thereof is a lower axial portion 91 of a linkage member 93. The member 93 also includes an upper axial portion 95 which extends axially, and rearwardly, through an opening near the upper end of the valve stem 29. Thus, the linkage member 93 is somewhat "Z-shaped", as shown in FIG. 5, and would typically be formed from a hardened spring wire. The general purpose of the linkage member 93 is to transmit the pivotal movement of the sector gear 73 about its axis A1 into linear movement of the valve stem 29 along its axis A2.

However, in accordance with a specific aspect of the invention, the orientation of the sector gear 73 and the configuration of the linkage member 93 are selected such that the opening (or closing) force and speed are not constant, but instead, are tailored to meet the needs of the EGR valve in the environment shown, i.e., with the poppet valve portion 27 being of the "pressure biased closed" type. As noted in the BACKGROUND OF THE DISCLOSURE, when the poppet valve portion 27 is of the pressure biased closed type, more force and less speed are needed, initially, as the valve begins to move from its closed position, shown in FIG. 2, toward an open position. Then, as the valve moves from a slightly open position toward a fully open position, as shown in FIG. 7, much less force is required, but more speed is required, in order to achieve the desired opening time.

Referring now primarily to FIG. 6, which corresponds to the closed position of the poppet valve portion 29 shown in FIG. 2, it may be seen that the sector gear 73 is oriented such that the location of the connection of the linkage member 93 and the sector gear 73 (i.e., the opening 89 and lower axial portion 91) is disposed transversely between the axis A1 of the sector gear mounting shaft 75 and the axis A2 of the valve stem 29. Thus, with the valve closed as in FIGS. 2 and 6, the linkage member 93 is oriented at an angle as shown in FIG. 6, and the speed of vertical motion of the valve stem 29 would be less, initially, than when the sector gear 73 has pivoted toward the position shown in FIG. 7, and the linkage member 93 is nearly vertical. In the FIG. 6 position, the location of the lower axial portion 91 is closer, in the transverse direction, to the axis A1, thus exerting a greater downward force on the valve stem 29 than in the FIG. 7 position, wherein there is now a greater transverse separation ("moment arm") and less downward force on the valve stem 29. It is believed that the mathematical relationships involved in the change from greater force to greater speed are well understood by those skilled in the art of four bar linkages.

Figure 7:
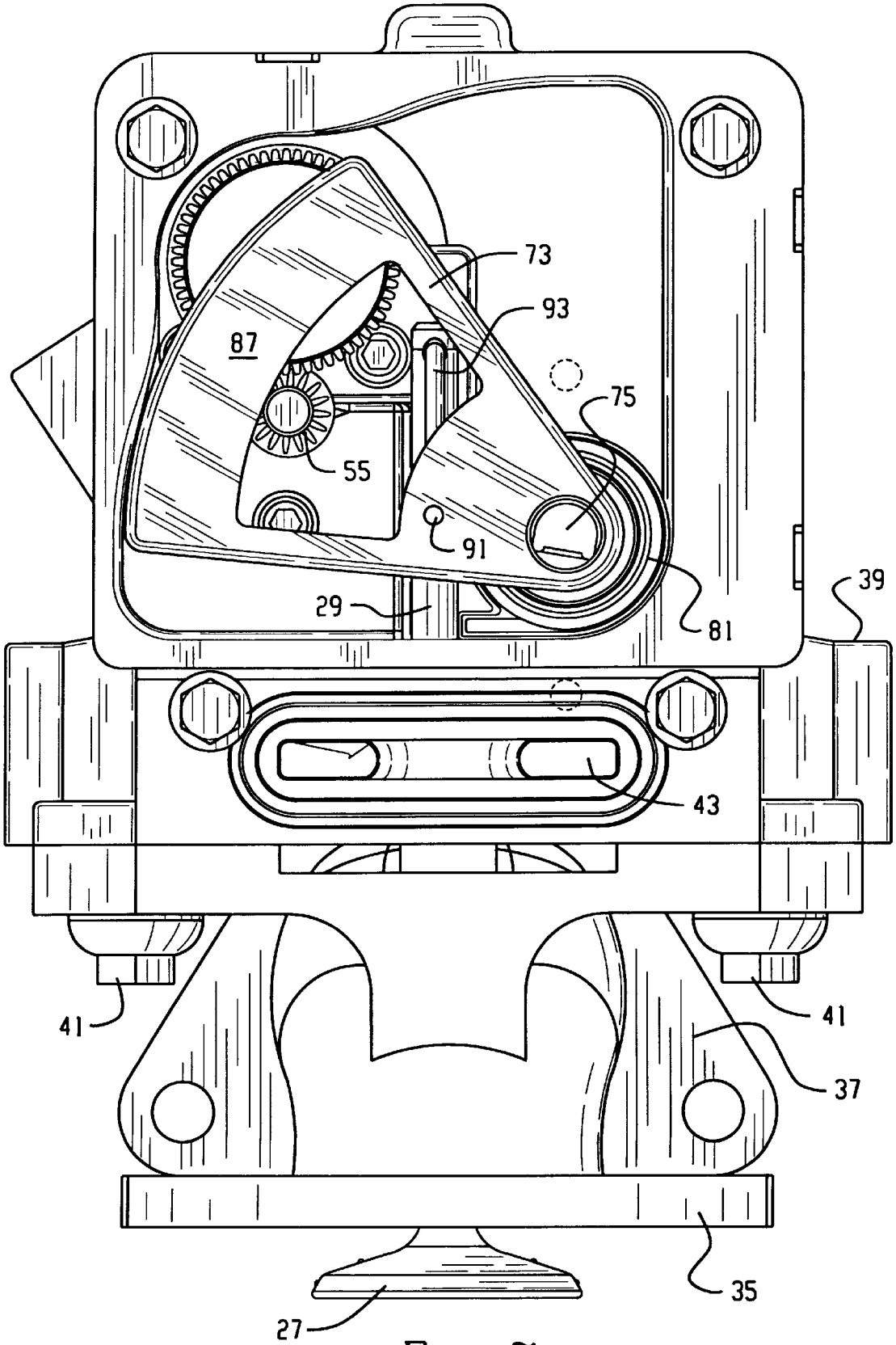
FIG. 7 is a front plan view, with the cover removed, of the entire actuator assembly, on a smaller scale than FIG. 6, with the valve in the open position.
Figure 8:
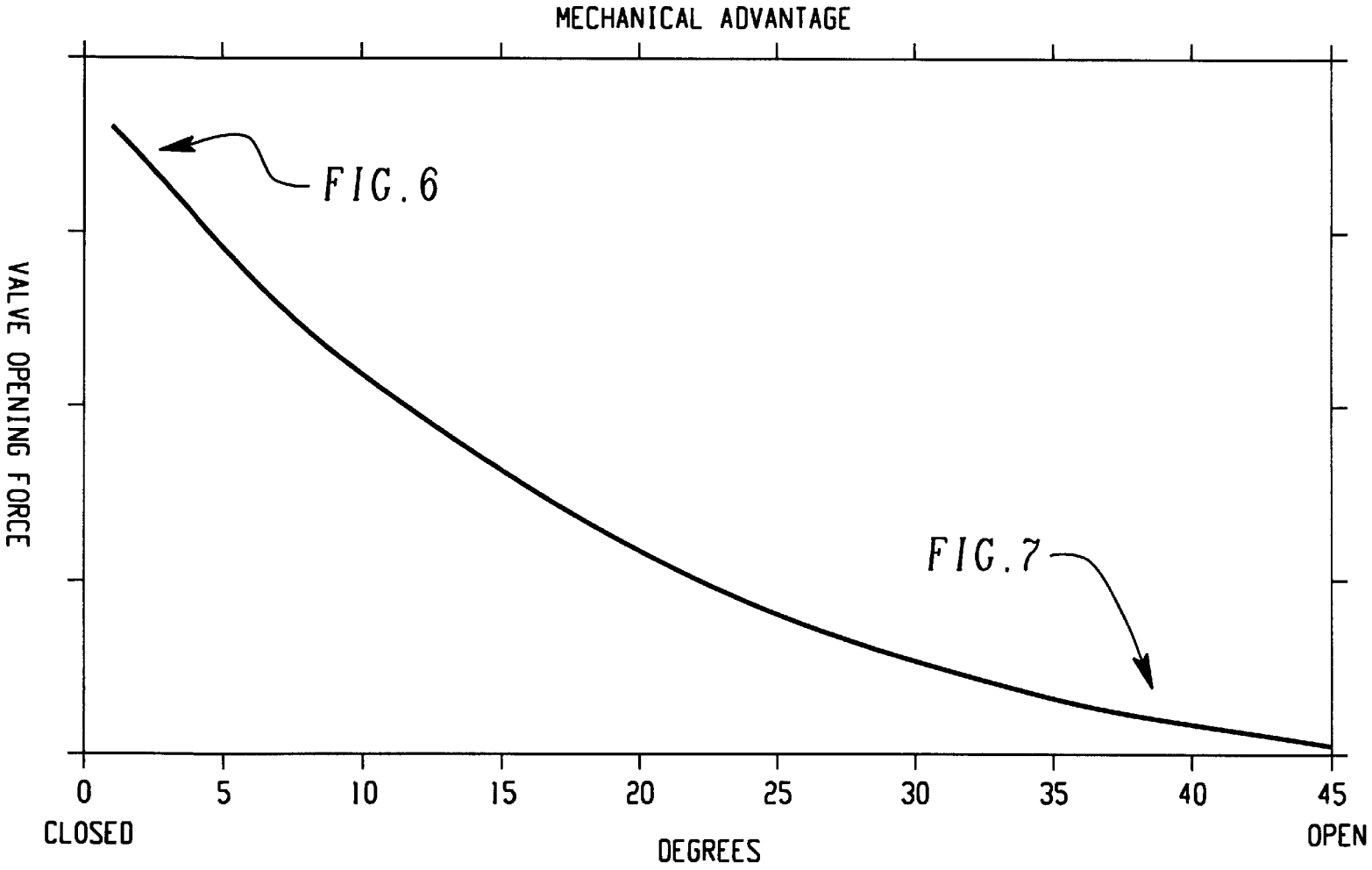
FIG. 8 is a graph of Valve Opening Force versus Degrees of pivotal movement of the sector gear, illustrating one of the advantages of the present invention.

This change in the relationship is illustrated in FIG. 8, which is a graph of Valve Opening Force versus Degrees, i.e., degrees of pivotal movement, counterclockwise, of the sector gear 73, starting in the FIG. 6 position ("closed"), and moving toward the FIG. 7 position ("open"). It will be understood by those skilled in the art of linkages and mechanical ratios, that the present invention provides the maximum mechanical advantage as the valve is just beginning to open in opposition to the force of the exhaust gas pressure, and the mechanical advantage gradually decreases as shown in FIG. 8, as less force is required to open the valve. Those skilled in the art will also understand that the speed of movement of the valve will follow a graph which is just the inverse of the graph of FIG. 8, starting slowly and gradually increasing to a maximum as the valve approaches the open position of FIG. 7.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An exhaust gas recirculation system for an internal combustion engine, said system having a valve including a valve stem, said valve being moveable between a closed position, blocking communication from an engine exhaust gas passage to an engine intake passage, and an open position, pressure in said engine exhaust gas passage biasing said valve toward said closed position; said system comprising housing means and an electric motor operably associated with said housing means and with an input gear to provide a relatively high speed, low torque motion to said input gear, in response to changes in an electrical input signal to said electric motor; said input gear being in driving engagement with an internally-toothed sector gear pivotable about a first axis; linkage means operably associated with said sector gear and said valve stem for transmitting pivotal movement of said sector gear into axial movement of said valve stem; characterized by:

(a) said sector gear and said linkage means being configured whereby, as said valve moves from said closed position toward said open position;

(i) said sector gear and said linkage means first generate an axial movement of said valve stem at a relatively higher force, and at a relatively lower speed;

(ii) then, as said valve opens further, said sector gear and said linkage means generate an axial movement of said valve stem at a relatively lower force, and at a relatively higher speed.

2. An exhaust gas recirculation system as claimed in claim 1, characterized by spring means operably associated with said sector gear and biasing said valve toward said closed position, said spring means associated with said sector gear comprising the only substantial biasing force, within said exhaust gas recirculation assembly, on said valve.

3. An exhaust gas recirculation system as claimed in claim 1, characterized by said valve stem defining a second axis, said input gear defining a third axis, and said first and third axes being disposed substantially perpendicular to said second axis.

4. An exhaust gas recirculation system as claimed in claim 3, characterized by said second axis being disposed transversely between said first and third axes.

5. An exhaust gas recirculation system as claimed in claim 4, characterized by said linkage means including a portion connected to said sector gear at a location disposed transversely intermediate said first and third axes, when said valve is in said closed position.

6. An exhaust gas recirculation system as claimed in claim 5, characterized by said linkage means portion being connected to said sector gear at a location disposed transversely approximately aligned with said first axis, when said valve is in said open position.

7. An exhaust gas recirculation system as claimed in claim 1, characterized by said input gear being in driving engagement with said internally-toothed sector gear by means of an intermediate gear train, to provide to said sector gear a relatively low speed, relatively high torque input.

8. An exhaust gas recirculation system as claimed in claim 7, characterized by said gear train comprising a relatively larger gear in toothed engagement with said input gear, and a relatively smaller gear in toothed engagement with said sector gear.

9. An exhaust gas recirculation system as claimed in claim 8, characterized by said gear train comprising a torque limiting coupling, operable to limit the torque transmitted from said input gear to said sector gear.

10. An exhaust gas recirculation system as claimed in claim 1, characterized by said sector gear being disposed forwardly of said valve stem, and said linkage means comprises a somewhat Z-shaped member including a lower axial portion engaging said sector gear, and an upper axial portion engaging said valve stem.

11. An exhaust gas recirculation system as claimed in claim 1, characterized by said sector gear including a set of internal teeth, and a forward cover portion disposed forward of said internal teeth, and radially inward thereof to form a lubrication enclosure in the region of the mesh of said internal teeth.

* * * * *